US012012956B2

(12) United States Patent
Fagot et al.

(10) Patent No.: US 12,012,956 B2
(45) Date of Patent: Jun. 18, 2024

(54) HYDRAULIC PUMP HAVING IMPELLER PUMP AND TROCHOID PUMP

(71) Applicant: THALES, Courbevoie (FR)

(72) Inventors: Gaëtan Fagot, Nantes (FR); Benoît Mary, Nantes (FR); Laurent Jeannerod, Luceau (FR); Marco Gonzalez, Luceau (FR); Fabien Ligeret, Luceau (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/982,223

(22) Filed: Nov. 7, 2022

(65) Prior Publication Data

US 2023/0151812 A1 May 18, 2023

(30) Foreign Application Priority Data

Nov. 8, 2021 (FR) ..... 2111834

(51) Int. Cl.
*F04C 11/00* (2006.01)
*F01C 21/08* (2006.01)
(Continued)

(52) U.S. Cl.
CPC ..... *F04C 11/005* (2013.01); *F01C 21/0809* (2013.01); *F04D 13/12* (2013.01);
(Continued)

(58) Field of Classification Search
CPC ..... F04C 11/005; F04C 2/102; F04C 11/008; F04C 2240/10; F04C 2240/20;
(Continued)

(56) References Cited

U.S. PATENT DOCUMENTS 2,713,244 A * 7/1955 Chaudler ..... F02C 7/236 417/301
4,789,299 A * 12/1988 Demetrius ..... F04D 3/02 416/177
(Continued)

FOREIGN PATENT DOCUMENTS

DE 40 38 438 A1 6/1992
DE 10 2018 212 497 A1 1/2020
(Continued)

OTHER PUBLICATIONS

English Machine Translation of PL196178B3 translated by USPTO Fit Database on Sep. 23, 2023 (Year: 2007).*
English Machine Translation of PL214431B1 translated by USPTO Fit Database on Sep. 23, 2023 (Year: 2013).*

*Primary Examiner* — Dominick L Plakkoottam
*Assistant Examiner* — Paul W Thiede
(74) *Attorney, Agent, or Firm* — BakerHostetler

(57) ABSTRACT

A hydraulic pump includes a casing, and an impeller pump having a rotor that is rotationally mobile with respect to the casing about a first axis. The rotor includes several blades in helix form, a transition zone belonging to the casing and having, on the side of the impeller pump, a ramp in helix form developing in the same direction as the helix form of the blades. A trochoid pump includes a rotor with outer toothing secured to the rotor of the impeller pump. A rotor with internal toothing is rotationally mobile with respect to the casing about a second axis parallel to and offset from the first axis. The trochoid pump is fed by the impeller pump through the transition zone running along the ramp.

8 Claims, 3 Drawing Sheets

(51) Int. Cl.

| | |
|---|---|
| ***F04C 2/10*** | (2006.01) |
| ***F04D 13/12*** | (2006.01) |
| ***F04D 29/18*** | (2006.01) |
| ***F04D 29/24*** | (2006.01) |
| ***F04D 29/54*** | (2006.01) |

(52) U.S. Cl.
CPC ..... *F04C 2/102* (2013.01); *F04C 11/008* (2013.01); *F04C 2240/10* (2013.01); *F04C 2240/20* (2013.01); *F04C 2240/30* (2013.01); *F04C 2240/60* (2013.01); *F04D 29/181* (2013.01); *F04D 29/242* (2013.01); *F04D 29/548* (2013.01)

(58) Field of Classification Search
CPC ..... F04C 2240/30; F04C 2240/60; F01C 21/0809; F04D 13/12; F04D 29/181; F04D 29/242; F04D 29/548
See application file for complete search history.

(56) References Cited

U.S. PATENT DOCUMENTS

| | | | | |
|---|---|---|---|---|
| 6,247,892 | B1 * | 6/2001 | Kazatchkov ..... | F04D 13/064 415/68 |
| 2005/0191186 | A1 | 9/2005 | Harris et al. | |
| 2013/0216401 | A1 * | 8/2013 | Kawano ..... | B04C 3/04 417/205 |
| 2017/0211577 | A1 | 7/2017 | Duncan et al. | |
| 2019/0345955 | A1 * | 11/2019 | DeClerck ..... | F04D 1/025 |
| 2020/0240428 | A1 * | 7/2020 | Springer ..... | F04D 29/225 |
| 2021/0285448 | A1 * | 9/2021 | Pippes ..... | F04C 23/003 |

FOREIGN PATENT DOCUMENTS

| | | | |
|---|---|---|---|
| PL | 196178 | B3 * | 7/2007 |
| PL | 214431 | B1 * | 7/2013 |

* cited by examiner

HYDRAULIC PUMP HAVING IMPELLER PUMP AND TROCHOID PUMP

CROSS-REFERENCE TO RELATED APPLICATION

This application claims priority to foreign French patent application No. FR 2111834, filed on Nov. 8, 2021, the disclosure of which is incorporated by reference in its entirety.

FIELD OF THE INVENTION

The invention relates to a hydraulic pump intended to transform mechanical energy into hydraulic energy. A hydraulic fluid conveyed by the hydraulic pump can notably be used as source of energy in a hydraulic motor or, more simply, to convey fluid, for example used to transport heat to or to lubricate certain mechanical components. More specifically, certain members, such as electrical machines for example, need to be cooled in their operation. A hydraulic fluid can circulate in parts of an electrical machine to take heat therefrom and transport it to a heat exchanger, to be discharged there.

BACKGROUND

The main parameters to be taken into account in choosing a hydraulic pump to ensure the circulation of fluid are: the pressure and the flow rate. These two parameters are of course linked. Indeed, for a given pump, a curve can be defined linking these two parameters for a given rotation speed. The operating point on this curve is defined as a function of the hydraulic circuit and notably of its height differences and its head losses.

Gear volumetric pumps are widely used for the circulation of hydraulic fluid. They deliver a flow rate that varies little as a function of the pressure, unlike centrifugal pumps. Gear pumps are simpler and more robust than piston pumps.

In the family of gear pumps, it is possible to distinguish the external gear pumps in which two wheels with outer toothing revolve in a chamber and the internal gear pumps that have two interleaved rotors, one with internal toothing and the other with external toothing meshing in one another. The internal rotor has fewer teeth than the external rotor. This difference in the number of teeth makes it possible to create mobile cavities between the teeth, cavities which displace the fluid. The internal gear pumps are more compact than the external gear pumps. Indeed, in an external gear pump, the two toothed wheels are disposed side by side whereas, in an internal gear pump, the two toothed wheels are disposed one inside the other. In an internal gear pump, it is possible to provide a protuberance of the stator in crescent form locally separating the two rotors. A pump without this protuberance is often called trochoid pump or "gerotor", the term "gerotor" being more specific in the literature.

In some particular uses, such as in aeronautics for example, the atmospheric pressure can be very low at high altitude and lead to difficulties in maintaining the circulation of the fluid. Indeed, a part of the circuit, notably present in a tank serving as buffer reservoir can be left at the surrounding pressure. In case of a flight at high altitude, the low pressure can result in the unpriming of the hydraulic pump. Other undesirable phenomena such as cavitation may also appear.

Moreover, the gear pumps operate well at low speed. However, in aeronautics, the turboprop engines operate within very high speed ranges, typically between 12000 and 30000 revolutions per minute. Currently, to drive a hydraulic pump by means of the shaft of a turboprop engine, it is necessary to provide a speed reducer.

SUMMARY OF THE INVENTION

The invention aims to mitigate all or part of the problems cited above by proposing a hydraulic pump that can be directly driven, without speed reducer, by a shaft that can revolve at high speed, typically up to 30000 revolutions per minute, and that can operate in an environment at very low pressure, typically when the atmospheric pressure corresponds to an altitude greater than 10000 m.

To this end, the subject of the invention is a hydraulic pump, comprising:

a casing, an impellor pump comprising a rotor that is rotationally mobile with respect to the casing about a first axis, the rotor comprising several blades in helix form, a transition zone belonging to the casing, and having, on the side of the impellor pump, a ramp in helix form developing in the same direction as the helix form of the blades, a trochoid pump comprising a rotor with external toothing secured to the rotor of the impellor pump, and a rotor with internal toothing that is rotationally mobile with respect to the casing about a second axis parallel to and offset from the first axis, the trochoid pump being fed by the impellor pump through the transition zone running along the ramp.

A helix pitch of the blades, defined along the first axis, advantageously increases towards an outlet of the impellor pump.

For each blade, an upper surface line is advantageously longer than a corresponding lower surface line, the lower surface and upper surface lines being both defined on a same cylindrical surface about the first axis.

The stator of the impellor pump can comprise a cavity in which the rotor of the impellor pump revolves, a section of the cavity, and a section of the rotor of the impellor pump, advantageously have a diameter that decreases towards the outlet of the impellor pump, the sections being defined at right angles to the first axis.

The rotor of the impellor pump can comprise a shaft extending along the first axis, the blades extending primarily radially about the shaft of the impellor pump, a diameter of the shaft of the impellor pump, defined at right angles to the first axis, increases advantageously towards the outlet of the impellor pump.

Each of the blades advantageously has a leading edge approaching the outlet of the impellor pump when its distance to the first axis increases.

BRIEF DESCRIPTION OF THE DRAWINGS

The invention will be better understood and other advantages will become apparent on reading the detailed description of an embodiment given as an example, the description being illustrated by the attached drawing in which.

In the interests of clarity, the same elements will bear the same references in the different figures.

DETAILED DESCRIPTION

The example described relates to a hydraulic pump 10 intended to be implemented in the aeronautical field and primarily to circulate a hydraulic fluid, in particular oil used to cool an electrical machine driven by the shaft of a turboprop engine. The hydraulic pump 10 is driven directly, that is to say without speed reducer, by the shaft of the turboprop engine. In other words, the hydraulic pump 10 is intended to operate within a very high speed range, that can typically reach a speed of the order of 30000 revolutions per minute.

The invention is not limited to the aeronautical field and can be implemented in any other field. The main benefit of the invention remains the possibility of achieving very high rotation speeds and of allowing operation in an environment where the intake pressure of the pump can drop well below the conventional atmospheric pressure at ground level.

Figure 1:
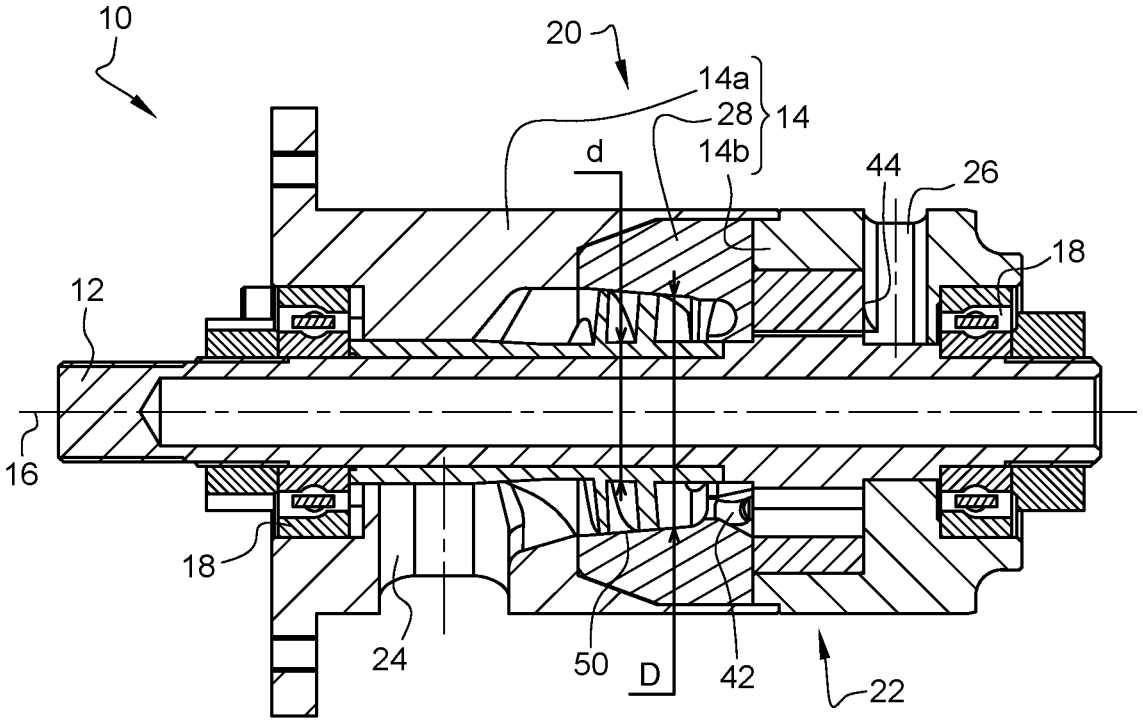
FIG. 1 represents, in longitudinal cross-section, an example of a hydraulic pump according to the invention.

FIG. 1 represents an example of a hydraulic pump 10 according to the invention. The hydraulic pump 10 is driven by a motor shaft 12 that revolves with respect to a casing 14 about an axis 16. FIG. 1 is a cross-sectional view in a plane containing the axis 16. A twin rolling bearing 18 guides the rotation of the motor shaft 12 with respect to the casing 14 about an axis 16. The hydraulic pump 10 comprises two pumps mounted in series: an impellor pump 20 and a trochoid pump 22. The impellor pump 20 feeds the trochoid pump 22. The impellor pump 20 and the trochoid pump 22 are driven by the same motor shaft 12. In FIG. 1, there is an intake duct 24 produced in the casing 14 and forming the intake of the impellor pump 20 and a discharge duct 26, also produced in the casing 14 and forming the outlet of the trochoid pump 22. A transition piece 28 forms both the outlet of the impellor pump 20 and the inlet of the trochoid pump 22. In practice, the casing 14 can be produced in several mechanical parts, two in the example represented: a first flange 14*a* and a second flange 14*b*. The transition piece 28 is nested in the flange 14*a*. It is also possible to nest the transition piece 28 in the flange 14*b*. The two flanges 14*a* and 14*b* and the transition piece 28 are all three secured to one another. Any other type of securing of the flanges 14*a*, 14*b* and of the transition piece 28 in position is possible in the context of the invention. To facilitate the manufacture or the assembly of the flanges 14*a*, 14*b* and of the transition piece 28, it is possible to provide for the functions of these parts to be fulfilled in more or fewer mechanical parts. Hereinbelow, the two flanges 14*a*, 14*b* and the transition piece 28, which jointly form the casing 14, will not be distinguished. The function fulfilled by the transition piece 28 will be called transition zone of the casing 14.

Figure 2:
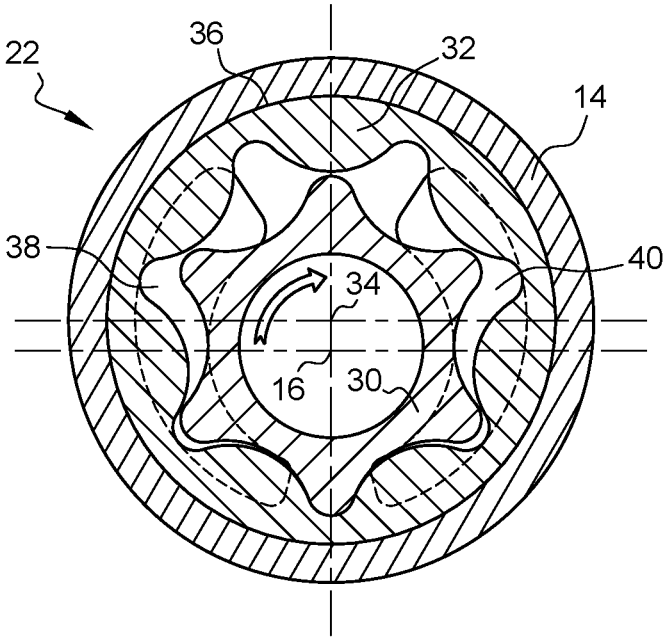
FIG. 2 represents, in transverse cross-section, a trochoid pump belonging to the pump of FIG. 1.

FIG. 2 represents the trochoid pump 22 in cross-section in a plane at right angles to the axis 16. The trochoid pump 22 comprises a rotor with external toothing 30 driven in rotation by the shaft 12 about the axis 16. The rotor with external toothing 30 is secured to the shaft 12. In practice, the rotor with external toothing 30 and the shaft 12 can be produced in one and the same mechanical part. The trochoid pump 22 also comprises a rotor with internal toothing 32 that can revolve freely in the casing 14 about an axis 34 that is offset from the axle 12 and parallel thereto. The casing 14 comprises a cylindrical cavity 36 of axis 34 forming the stator of the trochoid pump 22.

The rotor with external toothing 30 comprises six teeth and the rotor with internal toothing 32 comprises seven teeth in the example represented. The rotor with external toothing 30 drives the rotor with internal toothing 32 in rotation. More generally, the rotor with external toothing 30 comprises fewer teeth than the rotor with internal toothing 32. The difference in number of teeth creates a space between teeth which sucks the fluid into a zone 38 where the teeth separate and discharges it into a zone 40 where the teeth meet again in the rotation of the two rotors 30 and 32. The suction and discharge zones are represented respectively on the left and on the right of FIG. 2. In practice, the suction zone 38 corresponds to an aperture 42 produced in the transition zone and the discharge zone 40 corresponds to an aperture 44 produced in the casing 14 and communicating with the discharge duct 26.

Figure 3:
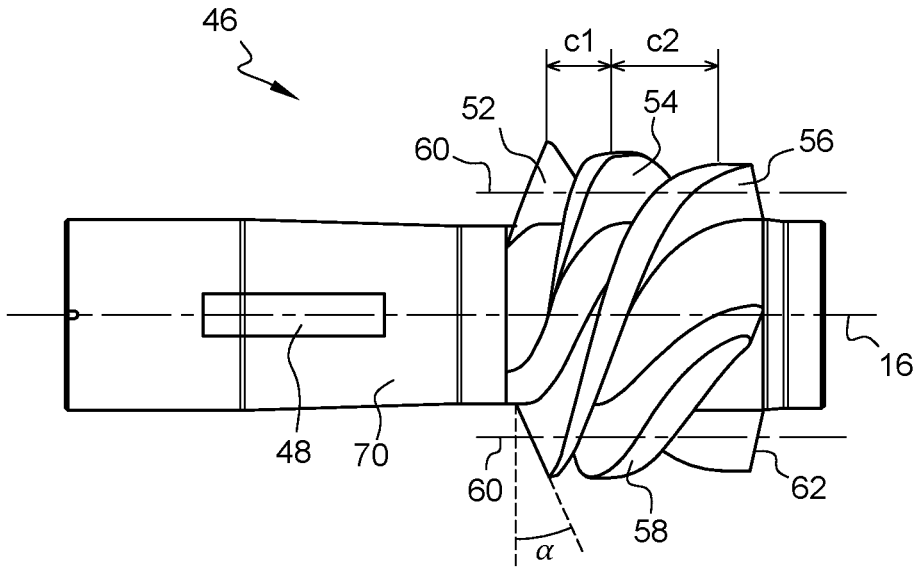
FIG. 3 represents, in a longitudinal view, the rotor of an impellor pump belonging to the pump of FIG. 1.

FIG. 3 represents a rotor 46 of the impellor pump 20. The rotor 46 is secured to the shaft 12. The rotor 46 and the rotor with external toothing 30 of the trochoid pump 22 are therefore driven in rotation with respect to the casing 14 about the axis 16 by the same shaft 12. The rotor 46 of the impellor pump 20 can be directly produced with the shaft 12 or produced in a separate mechanical part, as represented in FIGS. 1 and 3. The rotor 46 is immobilized with respect to the shaft 12, for example by means of a key 48. Separate production of the shaft 12 and of the rotor 46 makes it possible to avoid producing a shaft 12 that is too complex.

The rotor 46 revolves in a cavity 50 forming the stator of the impellor pump 20. The cavity 50 has a form of revolution about the axis 16. In the example represented, the cavity 50 is produced in the transition piece 28. It is recalled that the transition piece 28 and the flanges 14*a*, 14*b* are secured to one another.

The rotor 46 comprises several blades in helix form. In the example represented, the rotor 46 comprises four blades 52, 54, 56 and 58. Another number of blades can be envisaged. The number of blades depends notably on the desired helix pitch. This pitch can be fixed and identical for all the blades. Alternatively, it is advantageous to vary the helix pitch of each blade between the inlet and the outlet of the impellor pump 20. A smaller pitch at the inlet makes it possible to avoid abrupt pressure variations in the fluid between the intake duct 24 and the blades. Indeed, to allow the hydraulic pump 10 to operate with a low fluid pressure at the intake duct 24, it is advantageous to limit the variation in fluid pressure at the inlet of the impellor pump 20, notably to avoid the risk of cavitation. The helix pitch can then increase towards the outlet of the impellor pump 20 in order to increase the fluid pressure gradually before reaching the trochoid pump 22. In FIG. 3, the variation in pitch can be visualized by dimensions extending parallel to the axis 16. A first dimension c1 separates the blades 52 and 54 closest to the intake duct 24 and a second dimension c2, greater than the dimension c1, separates the blades 54 and 56 closest to the aperture 42 produced in the transition piece 28.

Figure 4:
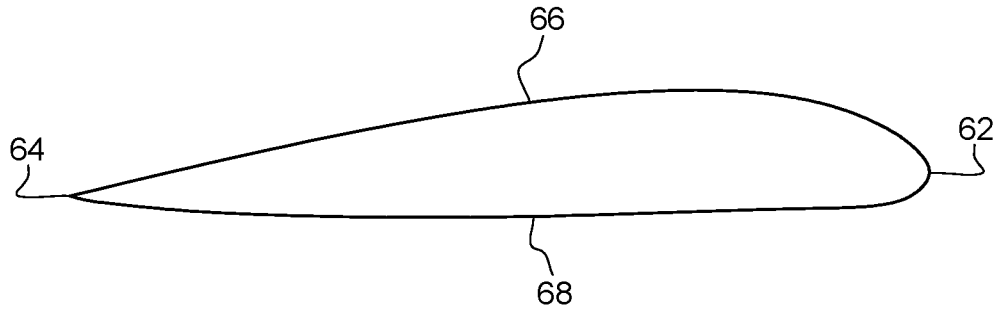
FIG. 4 represents an asymmetrical form that the blades of the impellor pump can take.

FIG. 4 represents an example of profile of the blades 52, 54, 56 and 58. This profile is a cross-section of a blade through a cylindrical surface 60 of axis 16 represented flat. The profile extends between a leading edge 62 situated closest to the intake duct 24 and a trailing edge 64 situated closest to the transition piece 28. The profile is asymmetrical. More specifically, an upper surface line 66 is longer than a corresponding lower surface line 68. The terms lower surface and upper surface are defined by analogy to those used for an aeroplane wing. The lower surface corresponds to the face of the blade where the pressure of the fluid is highest and the upper surface corresponds to the face of the blade where the pressure of the fluid is lowest. Among the asymmetrical profiles, it is possible to choose a profile defined by the "National Advisory Committee for Aeronautics" known by its acronym NACA. The implementation of such an asymmetrical profile makes it possible to increase the rotation speed of the impellor pump 20 by limiting the risks of cavitation to obtain the desired increase in pressure and flow rate. Other profiles are of course possible.

The cavity 50 forming the stator of the impellor pump 20 is of revolution about the axis 16. Between the blades 52, 54, 56, 58 and the cavity 50, a functional play is provided to allow the rotation of the blades. This functional play is as small as possible to limit the leaks and improve the efficiency of the impellor pump 20. The functional play is notably a function of the manufacturing tolerances of the various mechanical parts and of the possible thermal expansions during operation. It is possible to produce a cylindrical cavity 50 over the entire length of the cavity 50 defined along the axis 16 and swept by the blades. Alternatively and advantageously, the section of the cavity 50, defined at right angles to the axis 16, has a diameter D that decreases towards the aperture 42 forming the outlet of the impellor pump 20. The decrease in the diameter D is advantageously continual in order to limit the head losses. The radial dimensions of the blades 52, 54, 56, 58 follow this decrease. It is considered that, for any section, the nominal diameters of the blades and of the cavity 50 are equal plus or minus the functional plays. This change in the diameter D makes it possible to reduce the section of passage of the fluid from upstream to downstream of the impellor pump 20. This reduction of passage section makes it possible to increase the speed of the fluid and therefore its pressure in its passage through the impellor pump 20. This makes it possible to improve the efficiency of the impellor pump 20.

Alternatively or in addition to the form of the cavity 50, it is also possible to act on the internal diameter of the blades. More specifically, the rotor 46 of the impellor pump 20 comprises a shaft 70 secured to the shaft 12. As has been seen previously, the shaft 70 and the shaft 12 can be produced in a single mechanical part or in two separate mechanical parts. The shaft 70 is of revolution about the axis 16. The blades 52, 54, 56 and 58 extend radially from the shaft 70, about the axis 16. The shaft 70 and the blades 52, 54, 56, 58 form the rotor 46 of the impellor pump 20. The external diameter d of the shaft 70, defined at right angles to the axis 16, can be constant over the entire zone where the blades 52, 54, 56 and 58 are installed. Alternatively, the external diameter d of the shaft 70 can increase towards the outlet of the impellor pump 20. This change in the diameter d of the shaft 70 contributes to the reduction of section of passage of the fluid towards the outlet of the impellor pump 20. Advantageously, the external diameter d increases continually towards the outlet of the impellor pump 20 in order to limit the head losses.

In the impellor pump 20, the fluid is in direct contact on the one hand with the shaft 70 and on the other hand with the cavity 50.

The fact of increasing the diameter d of the shaft 70 and/or of reducing the diameter D of the cavity 50 towards the outlet of the impellor pump 20 makes it possible to better adapt to the definition of the trochoid pump 22 and more specifically to the position of the aperture 42 of the transition piece 28 forming both the outlet of the impellor pump 20 and the suction zone 38 of the trochoid pump 22.

The leading edge 62 of the blades 52, 54, 56 and 58 of the impellor pump 20 can extend at right angles to the axis 16. Alternatively, it is possible to incline the leading edge with respect to a direction at right angles to the axis 16. More specifically, the leading edge 62 approaches the outlet of the impellor pump 20 when its distance to the axis 16 increases. Inclination can be constant and the leading edge 62 can form a line segment as represented in FIG. 3. The inclination of the line segment is represented by an angle $\alpha$. It is also possible to incline the leading edge 62 in a changing manner when its distance to the axis 16 increases. This inclination makes it possible to improve the penetration of the fluid into the impellor pump 20 to limit the risk of cavitation and its potentially destructive effects.

Figure 5:
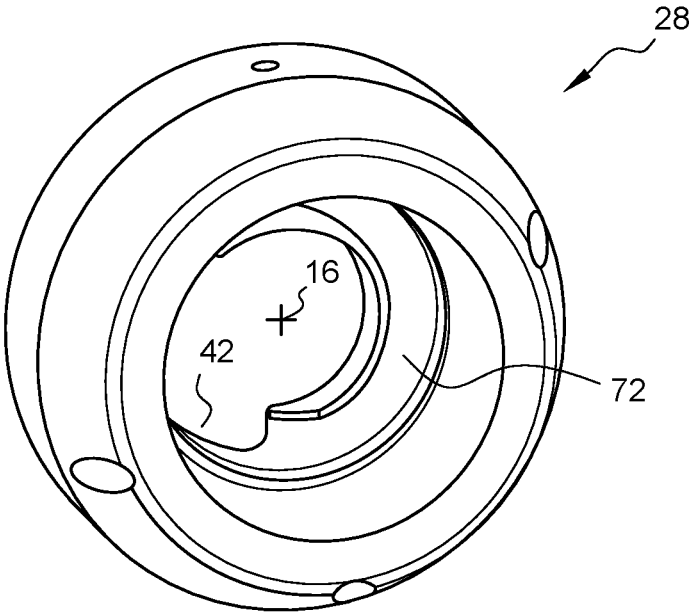
FIG. 5 represents, in perspective, a transition piece belonging to the pump of FIG. 1.

FIG. 5 represents, in perspective, the transition piece 28. The aperture 42 forming the outlet of the impellor pump 20 and the suction zone 38 of the trochoid pump 22 are distinguished. The transition piece 28 comprises a ramp 72 that makes it possible to guide the fluid at the outlet of the impellor pump 20 before reaching the aperture 42. In other words, the ramp 72 is situated between the impellor pump 20 and the trochoid pump 22 on the side of the impellor pump 20. The fluid runs along the ramp 72 to reach the aperture 42. The ramp 72 is advantageously in helix form developing in the same direction as the helix form of the blades 52, 54, 56 and 58 in order to limit the head losses between the two pumps 20 and 22.

The invention claimed is:

1. A hydraulic pump, comprising:

a casing, an impellor pump comprising a rotor that is rotationally mobile with respect to the casing about a first axis, the rotor comprising several blades in helix form, a transition piece defining a transition zone within the casing and said transition piece having, on a side of the impellor pump, a ramp in helix form developing in a same direction as the helix form of the blades, a trochoid pump comprising a rotor with outer toothing secured to the rotor of the impellor pump, and a rotor with internal toothing that is rotationally mobile with respect to the casing about a second axis parallel to and offset from the first axis, the trochoid pump being fed by the impellor pump through the transition zone running along the ramp.

2. The hydraulic pump according to claim 1, wherein a helix pitch of the blades that is defined along the first axis increases towards an outlet of the impellor pump.

3. The hydraulic pump according to claim 1, wherein, for each blade, an upper surface line is longer than a corresponding lower surface line, the lower surface and upper surface lines being both defined on a same cylindrical surface about the first axis.

4. The hydraulic pump according to claim 1, wherein a stator of the impellor pump is formed by a cavity defined by the transition piece and in which the rotor of the impellor pump revolves wherein a section of the cavity and a section of the rotor of the impellor pump each have a diameter that decreases towards an outlet of the impellor pump, the sections being defined at right angles to the first axis.

5. The hydraulic pump according to claim 4, wherein the diameter decreases continually.

6. The hydraulic pump according to claim 1, wherein the rotor of the impellor pump comprises a shaft extending along the first axis, the blades extending primarily radially about the shaft of the impellor pump, and a diameter of the shaft of the impellor pump, defined at a right angle to the first axis, increases towards an outlet of the impellor pump.

7. The hydraulic pump according to claim 6, wherein the diameter of the shaft increases continually.

8. The hydraulic pump according to claim 1, wherein each of the blades has a leading edge approaching an outlet of the impellor pump such that a distance of the leading edge to the first axis increases.

* * * * *